US005806266A

United States Patent [19]

Jennings et al.

[11] Patent Number: 5,806,266

[45] Date of Patent: Sep. 15, 1998

[54] BEAM MEMBER HAVING AN ADJUSTABLE CURVATURE

[75] Inventors: Bob L. Jennings; Eugene C. Postma, both of Polk County, Iowa

[73] Assignee: Wilian Holding Company, Des Moines, Iowa

[21] Appl. No.: 499,611

[22] Filed: Jul. 7, 1995

[51] Int. Cl.[6] ..... E04C 3/02; E04G 9/02

[52] U.S. Cl. ..... 52/644; 52/223.8; 52/639; 52/740.8; 249/155; 249/189

[58] Field of Search ..... 52/740.8, 223.8, 52/223.12, 639, 644, 631; 249/155, 189

[56] References Cited

U.S. PATENT DOCUMENTS

| | | | |
|---|---|---|---|
| 2,197,318 | 4/1940 | Rumble . | |
| 3,206,888 | 9/1965 | Litzka | 52/644 |
| 4,679,763 | 7/1987 | Brotherton . | |
| 4,964,256 | 10/1990 | McCracken . | |
| 5,291,717 | 3/1994 | Turner | 52/631 X |

FOREIGN PATENT DOCUMENTS

| | | | |
|---|---|---|---|
| 1558046 | 1/1969 | France | 52/223.8 |
| 2335998 | 2/1974 | Germany | 52/223.8 |

*Primary Examiner*—Carl D. Friedman
*Assistant Examiner*—Timothy B. Kang
*Attorney, Agent, or Firm*—Kent A. Herink; Brian J. Laurenzo; Michael C. Gilchrist

[57] ABSTRACT

A beam member for use in construction, particularly as a waler in concrete form assemblies, and a method of producing the same. The beam member is flexible to a preselected curvilinear shape and adapted to be held in said preselected curvilinear shape, and includes a flexible face and a plurality of flange members secured to and upstanding from the flexible face, the flange members being arranged side-to-side in two rows, one each of which rows is adjacent a corresponding one of opposing sides of the flexible face. Each of the flanges has a terminal end section extended parallel to the flexible face and is separated from an adjacent flange by a distance which increases from the attachment of the flange at the flexible face to said terminal end section whereby the beam member is laterally flexibly movable to conform to a preselected curvilinear shape. A strap is secured to the terminal end section of the flanges to maintain the preselected curvilinear shape of the beam member.

18 Claims, 5 Drawing Sheets

BEAM MEMBER HAVING AN ADJUSTABLE CURVATURE

BACKGROUND OF THE INVENTION

The invention relates generally to beam members for use in construction and, more specifically, to beam members for use in concrete forming apparatus, particularly a waler having a curvature that is adjustable.

Concrete forming systems are well known and widely used in the construction of diverse concrete structures. Certain of these systems make use of beams or soldiers as upright and horizontal structural members, inclined braces, columns, shores, walers, and the like. An example of such beam members are those described in U.S. Pat. No. 4,964,256.

A common use of concrete forming systems is in the forming and construction of concrete structures having curved or arcuate sections, such as tanks, tunnels, curved walls, and the like. U.S. Pat. No. 4,679,763 teaches a flexible metal panel that may be adjusted for use in forming concrete structures having planar or arcuate surfaces or both. Such panels generally require the use of a supporting structure of beam members or similar form work to hold the panels in position during pouring and curing of the concrete.

The beam members of the present invention are flexible to conform to a complex arcuate shape and, after being conformed to the desired shape, are adapted to hold that desired shape during the use of the beam member, for example in forming a concrete structure.

SUMMARY OF THE INVENTION

The invention consists of a flexible beam member that is adjustable for use in the construction of diverse structures having arcuate shapes. The beam member is of particular use as a waler in the support of concrete form assemblies. The beam member includes a flexible face on the back side of which is secured a plurality of flanges arranged side-by-side in two parallel rows positioned on either side of the longitudinal centerline of the flexible face. Each flange is generally L-shaped and consists of a flat plate member folded into a base section and a terminal end section. The base section of each flange is secured to the flexible face by weldments or the like and extends upwardly therefrom such that the terminal end sections are oriented parallel to the flexible face. Additionally, each base section is trapezoidal whereby the gap between adjacent flanges increases from a narrow gap at the flexible face to a wider gap at the terminal end section so that the beam member is flexible to conform to a curvilinear shape within limits. Means is provided for holding the beam member in its conformed, curvilinear shape. In the preferred embodiment, such means include a strap that is positioned atop the overturned terminal end portions of the flanges and may be held in place by a plurality of nut and bolt combinations inserted through aligned openings in the strap and the terminal end sections. A pair of end plates are attached at the ends of the flexible face and secured to the flexible face and to the pairs of flanges positioned at the ends of the beam member. A plurality of openings in the flexible face are used to attach diverse other structural components or concrete form assembly components to the beam members.

An object of the invention is to provide a beam member of adjustable curvature for use as a structural component or in concrete form assemblies.

Another object of the invention is to provide a concrete form waler for supporting a concrete form during pouring and curing of a curvilinear concrete structural section.

These and other objects of the invention will be made apparent to a person skilled in the art upon a review of this specification, the associated drawings and the appended claims.

DETAILED DESCRIPTION OF A PREFERRED EMBODIMENT

Figure 1:
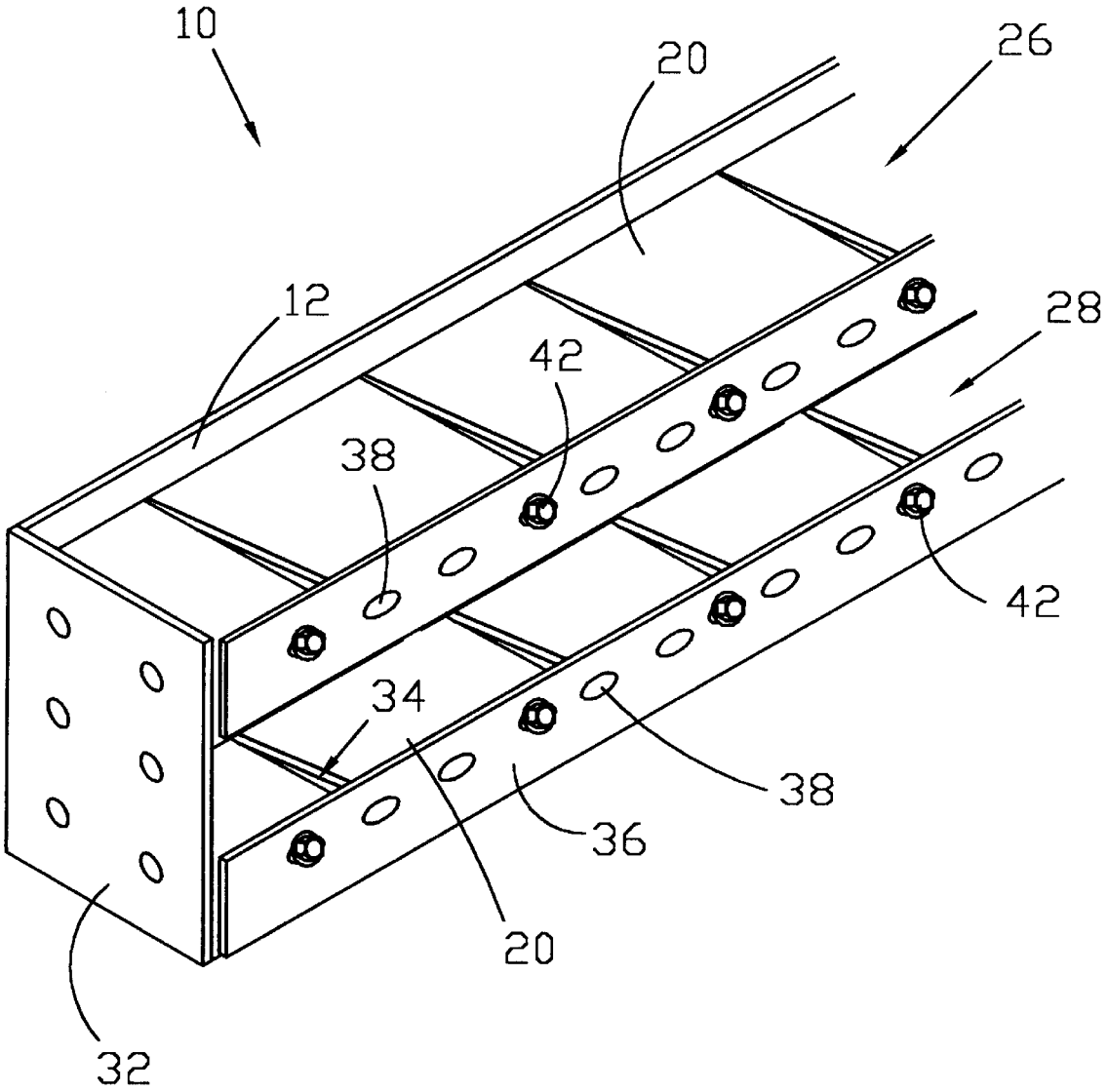
FIG. 1 is a perspective view of a beam member of the present invention.
Figure 4:
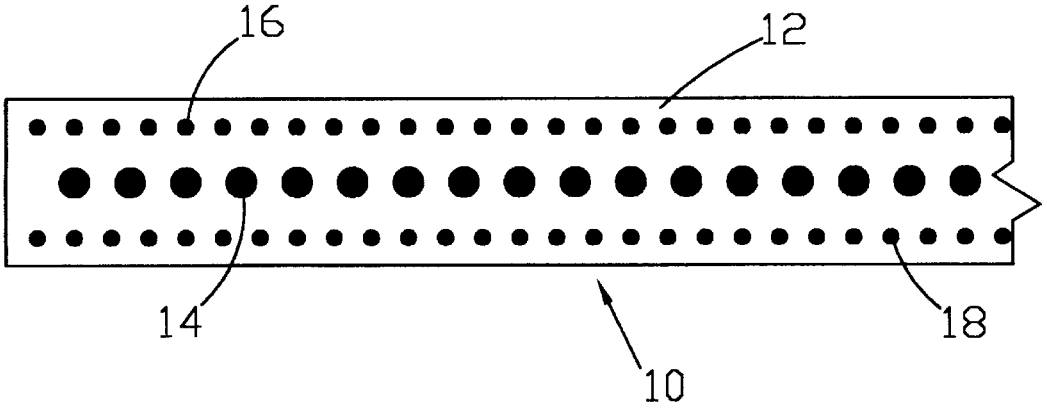
FIG. 4 is a front view of the beam member.
Figure 5:
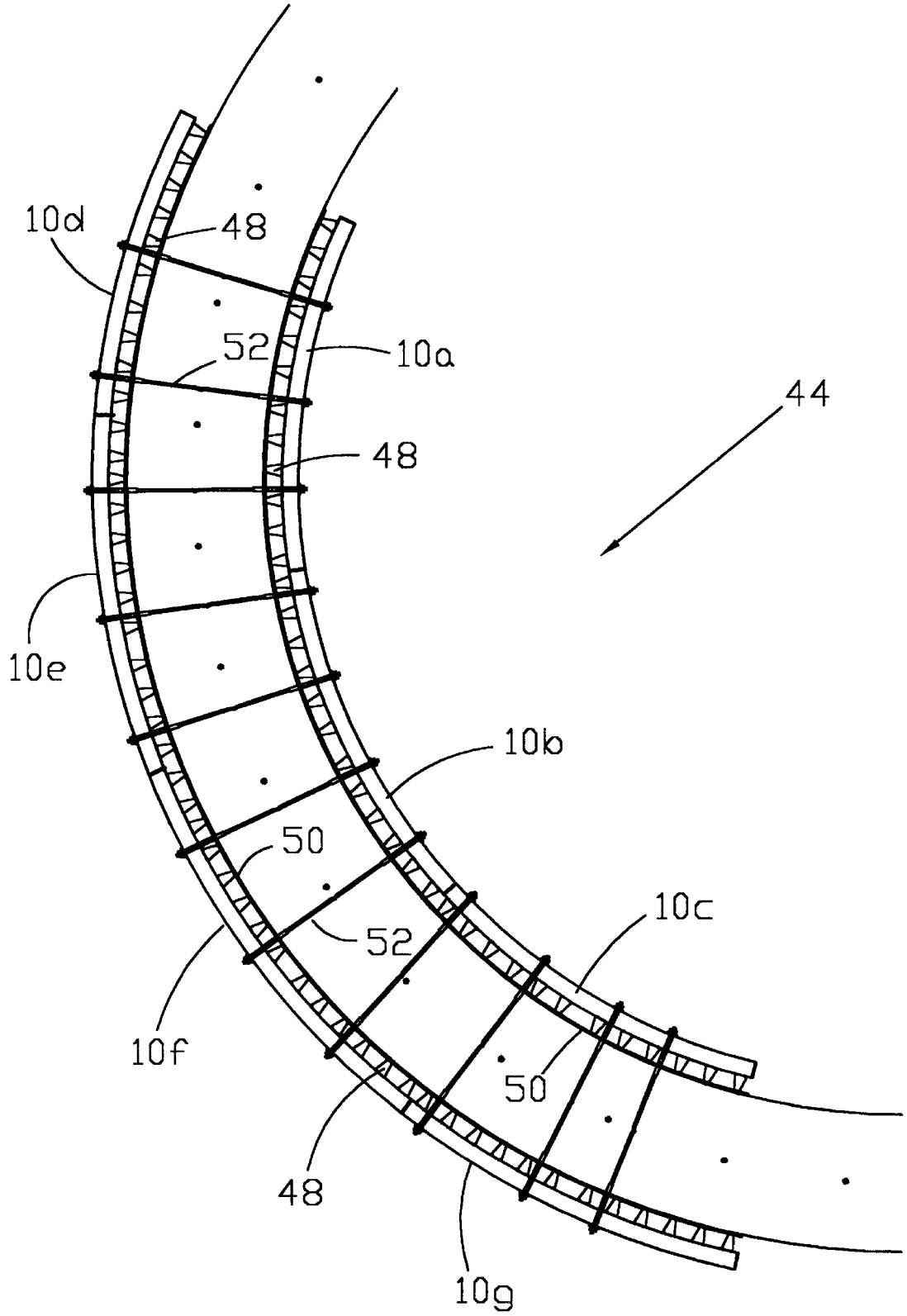
FIG. 5 is a plan view of a plurality of the beam members used in a concrete form assembly for pouring a concrete wall having an annular section.
Figure 6:
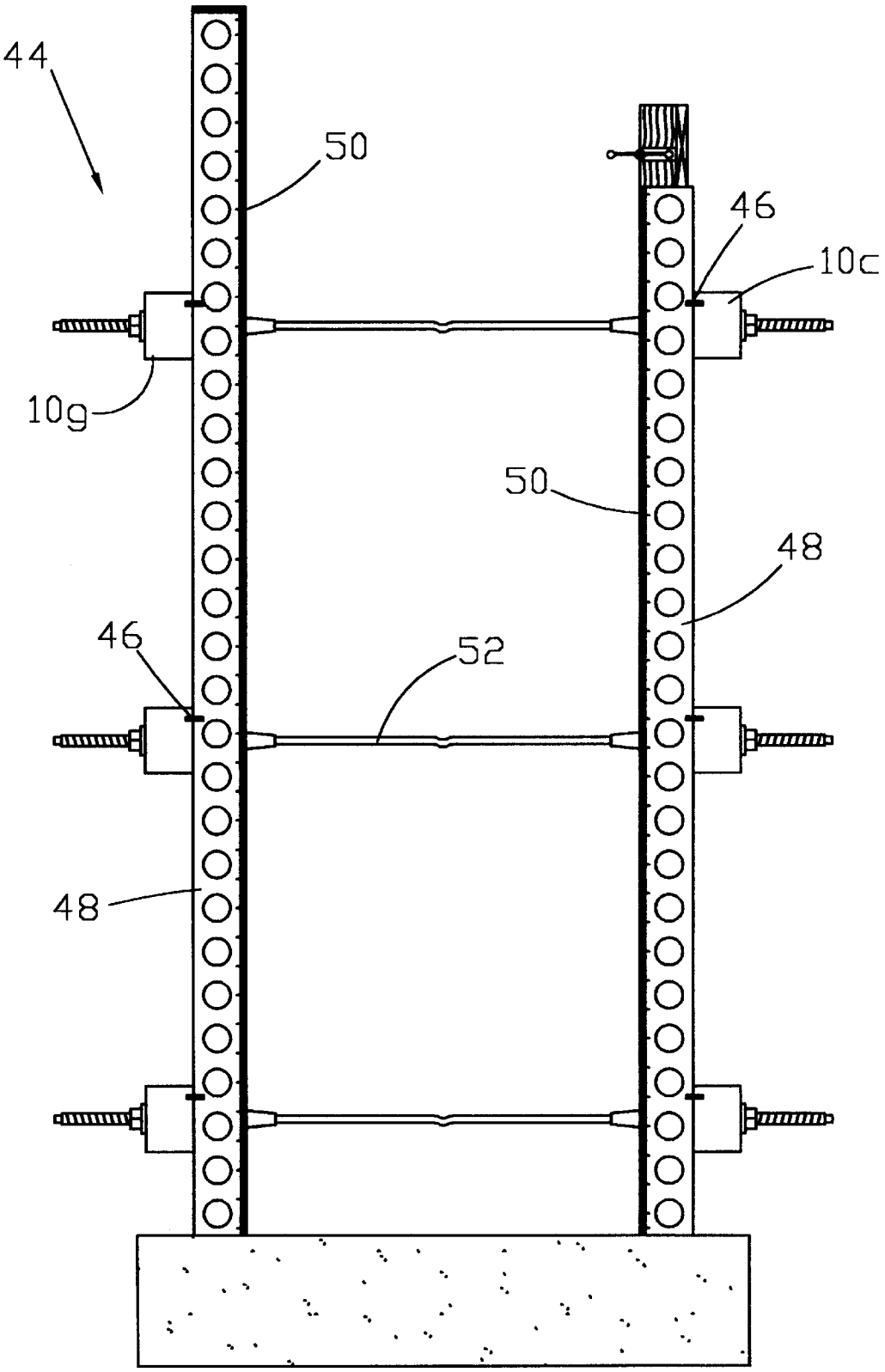
FIG. 6 is a cross sectional view in elevation of the concrete form assembly of FIG. 5.

Referring to FIG. 1, there is illustrated, generally at 10, an adjustable beam member for use in the construction of structures, particularly walers in concrete form assemblies such as illustrated in FIGS. 5 and 6. The beam member 10 includes a flexible face 12 that is perforated by a plurality of throughbores, a row of spaced-apart large throughbores 14 running longitudinally centrally of the flexible face 12, and two parallel rows of spaced-apart small throughbores 16 and 18 on either side of the row of large throughbores 14 (FIG. 4). The throughbores 14, 16, and 18 are useful in attaching concrete form or building components to the beam member 10, usually by means of nut and bolt combinations.

Figure 2:
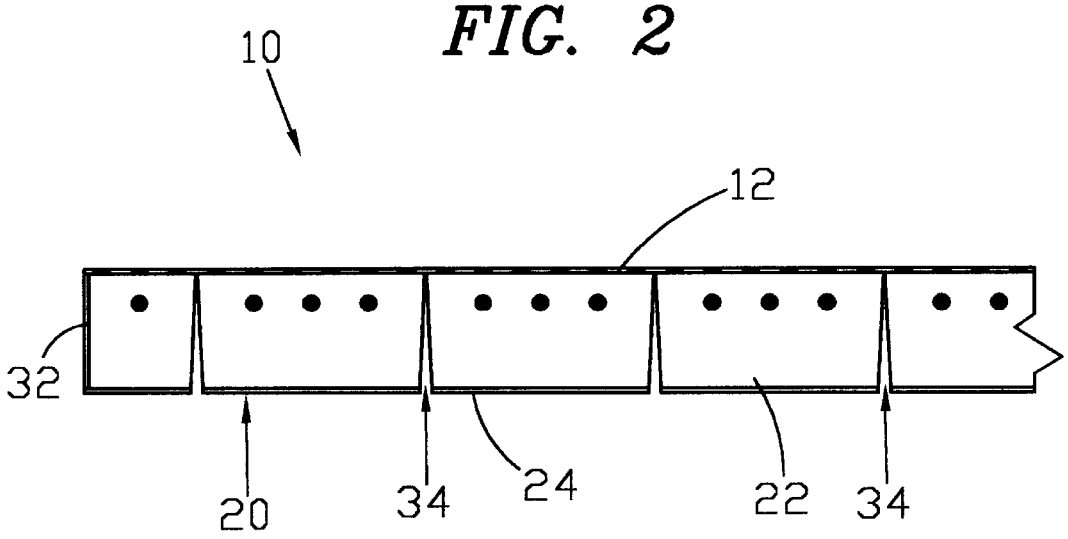
FIG. 2 is a plan view of the beam member.
Figure 3:
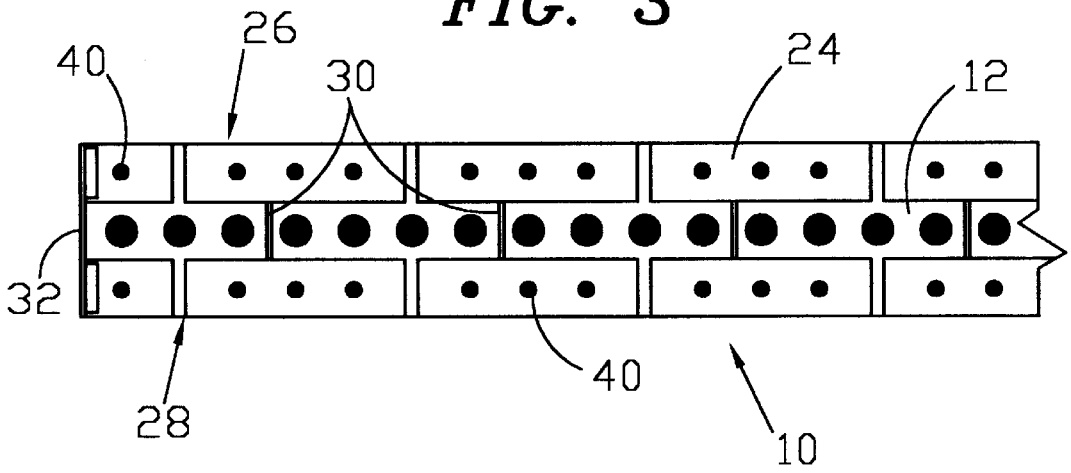
FIG. 3 is a back view of the beam member.
Figure 7:
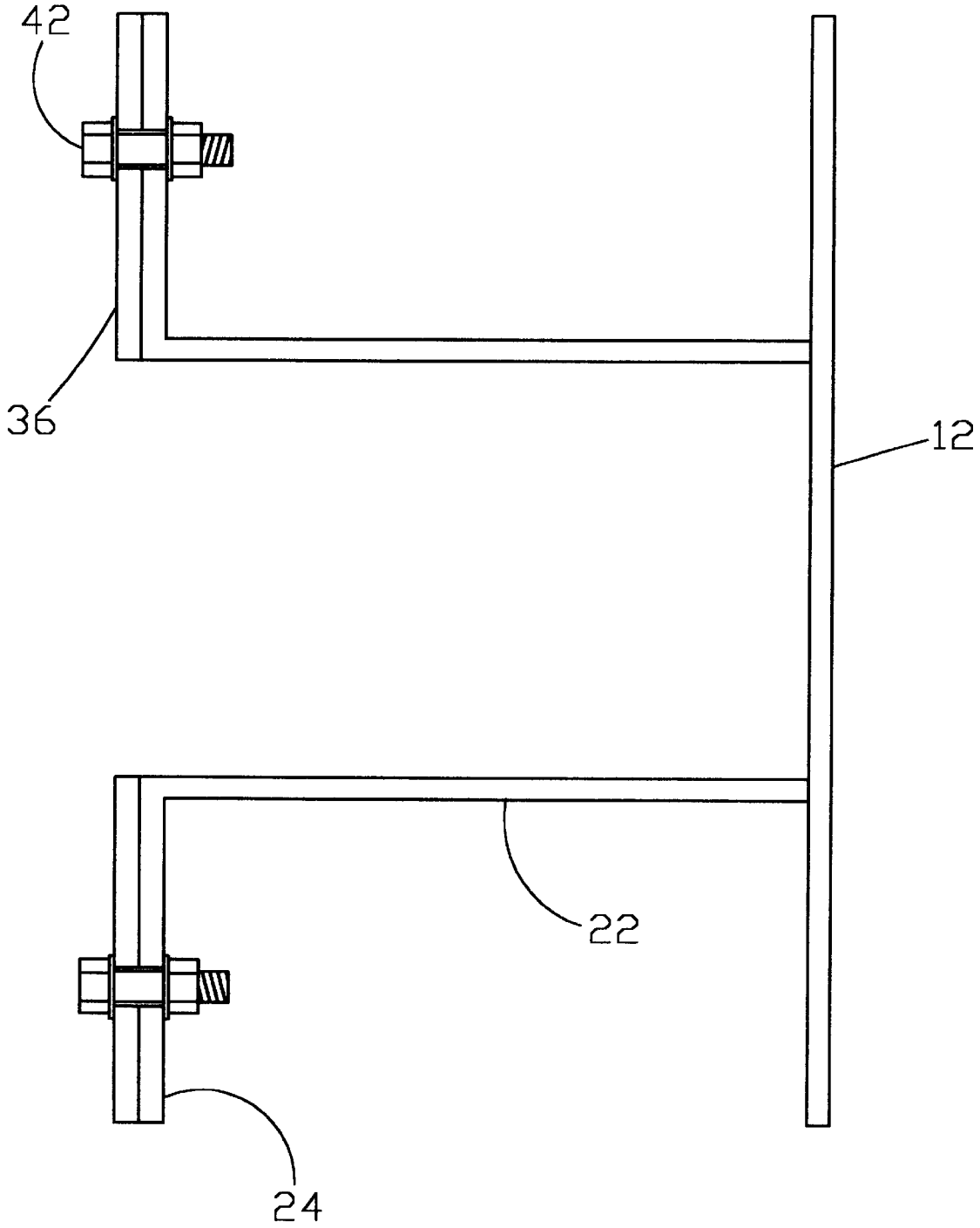
FIG. 7 is a cross sectional view of the beam member.

A plurality of flanges 20 are secured to a back side of the flexible face 12 (FIGS. 2, 3 and 7). The flanges 20 are of a generally L-shape having a base section 22 and a terminal end section 24. The flanges 20 are arranged side-by-side in two parallel rows 26 and 28 on either side of the longitudinal centerline of the flexible face 12, and are secured to the back side of the flexible face 20 by weldments or the like. The terminal end sections 24 of the mounted flanges 20 are turned outwardly away from the longitudinal centerline. A plurality of braces 30 are secured by weldments or the like to the flexible face 12 and to an opposite pair of flanges 20. An end plate 32 is secured by weldments or the like to each end of the flexible face 12 and to the pair of opposing flanges, or portions thereof, at each end of the beam member.

The base section 22 of each flange 20 is wider at the end portion that is attached to the flexible face 12 and tapers toward the bending line of the terminal end section 24. The flanges 20 are positioned side-by side in a row so that the end portions of adjacent flanges are in close proximity. Accordingly, the space or gap 34 between adjacent flanges increases from the attachment of the flange 20 at said flexible face 12 to said terminal end section 24, as best illustrated in FIGS. 1 and 2. The beam member 10 is therefore flexible about any line in the original plane of the flexible face 12 and perpendicular to the longitudinal centerline thereof. If the arc of curvature through any such line results in an adjacent pair of flanges moving closer to each other (defined herein as a positive arc of curvature), the gap 34 accommodates the flexing of the flexible face 12 until the adjacent edges of the two flanges come into contact engagement. Of course, the beam member 10 is also flexible into a negative arc of curvature through any such line whereby an adjacent pair of flanges move away from each other.

The minimum radius of the positive arc of curvature is limited by the shape of the gap 34, the width of the end portion of the base sections 22 of the flanges 20 attached to the flexible face 12, and by the flexibility of the flexible face 12 before it deforms or kinks. While the thinner the sheet material comprising the flexible face 12, the more flexible the beam member 10, a thinner flexible face 12 also decreases the strength of the beam member 10 when used in place in a building or other structure or in a concrete forming apparatus. The minimum positive radius of curvature can also be decreased by making the taper of the gap 34 between the flanges 20 more severe.

The beam member 10 also includes a tension member or strap 36 formed with a plurality of longitudinally spaced, elongated openings 38 (FIG. 1). The terminal end section 24 of each flange 20 includes three longitudinally spaced openings 40 (FIG. 3) for alignment with the elongated openings of the strap 38. Nut and bolt assemblies 42 are inserted through the aligned ones of the openings 38 and 40 and, upon being tightened, serve to lock the flanges 20 against movement relative to each other and thereby maintain the beam member 10 in the shape it possessed when the nut and bolt combinations were tightened. To conform the beam member 10 to a desired curvilinear shape, the nut and bolt combinations 42 are loosened and perhaps removed. The beam member can then be flexed to the desired shape by the use of manual manipulation, assisted if necessary by clamps, bars, or other tools. A beam member of the preferred embodiment, for example, can be conformed by placing it atop a template and applying a small weight to flex the beam member to conform to the template at each point along the length of the beam member. As each portion of the beam member is flexed to the desired shape, the nut and bolt combinations 42 corresponding to that section are inserted and tightened to lock the beam member into the desired shape. The elongated openings 38 of the strap 36 sufficient accommodation is present to permit alignment with the openings 40 of the flanges 20 to effectively lock the beam member 10 in its desired shape up to the minimum radius of curvature of the beam member.

An example of use of the beam member 10 as a waler in a concrete form assembly 44 is illustrated in FIGS. 5 and 6. The assembly 44 is for the purpose of pouring a circular section of a concrete wall of a receiving tank having an outer radius of twenty-five feet, six inches, and includes three beam members 10*a–c* for an inner form subassembly and four beam members 10*d–g* for an outer form subassembly. A plurality of lightweight steel beams 48 available from Economy Forms Corporation, Des Moines, Iowa, which are described in U.S. Pat. No. No. 5,307,601 (incorporated herein by this reference), and identified by the mark E-BEAM®, are secured by nut and bolt combinations 46 to the flexible face of each beam member 10. Wood sheets 50 are nailed to the steel beams 48 and are the surface against which the concrete is poured. The inner and outer subassemblies are tied together in the usual fashion by tie rods 52 extending between opposing beam members 10.

In the preferred embodiment, the flexible face 12 of the beam member 10 is formed of one-quarter inch steel 12 feet long and 9 inches wide. The flanges 20 are formed of one-quarter inch steel and are 11 15/16 inches wide at the wide end of the base section 22, tapering to 11⅜ inches wide at the fold line of the terminal end section 24. Adjacent flanges are spaced 1/16 inch apart at the flexible face 12. The strap 36 is also one-quarter inch steel and is secured to the terminal end sections of the flanges 20 by ¾ inch nut and bolt combinations torqued to 250 foot lbs. The minimum radius of curvature of the beam member 10 of the preferred embodiment is seventeen feet; with the same materials, the taper of the gap 34 may be increased from three-eighths inches to one-half inch and the minimum radius reduced to about ten feet.

Although the invention has been described with respect to a preferred embodiment thereof, it is to be also understood that it is not to be so limited since changes and modifications can be made therein which are within the full intended scope of this invention as defined by the appended claims.

We claim:

1. A beam member flexible to a preselected curvilinear shape and adapted to be held in said preselected curvilinear shape, the beam member for use in a multi-component assembly wherein the beam member is attached to ther components of the assembly, the beam member comprising:

(a) a flexible face having a longitudinal centerline and a plurality of apertures in said flexible face for use in attaching said beam member to the other components of the assembly;

(b) a plurality of flange members secure to and upstanding from said flexible face, said flange members are arranged side-to-side in at least one longitudinal row spaced from said longitudinal centerline of said flexible face;

(c) each of said flanges has a terminal end section extended parallel to said flexible face;

(d) each of said flanges is separated from an adjacent flange by a distance which increases from the attachment of the flange at said flexible face to said terminal end section whereby the beam member is laterally flexibly movable to conform to a preselected curvilinear shape; and (e) means secured to said terminal end section of said flanges to maintain the preselected curvilinear shape of the beam member.

2. A beam member as defined in claim 1, wherein said terminal end section of said flanges is turned outwardly away from said longitudinal centerline of said flexible face.

3. A beam member as defined in claim 1, further comprising a pair of opposing ends of said flexible face and a pair of end plates one each of which is secured to a corresponding one of said ends of said flexible face.

4. A beam member as defined in claim 1, wherein said means for maintaining the preselected shape of the beam member comprises a flexible strap for each of said rows of flanges and positioned atop and adapted for connection to said terminal end sections.

5. A beam member as defined in claim 4, wherein said terminal end sections include a throughbore, said strap includes a plurality of slotted throughbores capable of being aligned with said throughbores of said terminal end sections and whereby said strap is releasably connected to said terminal end sections by a plurality of nut and bolt combinations inserted through said aligned throughbores.

6. A beam member as defined in claim 1, wherein said beam member includes two longitudinal rows of said flanges positioned on either side of and spaced from said longitudinal centerline of said flexible face.

7. A beam member as defined in claim 1, wherein said distance of separation between adjacent flanges extends substantially from the attachment of said flange members at said flexible face to said terminal end sections.

8. A beam member as defined in claim 1, wherein the longitudinal length of said flange members greatly exceeds the distance of separation between adjacent flange members.

9. A beam member as defined in claim 1, wherein said means for maintaining preselected shape further comprises:

(a) a flexible, originally planar strap with transverse dimension greatly exceeding the thickness of said flexible strap; and (b) said flexible strap flexes about any line in the original plane of said flexible strap and perpendicular to the longitudinal center line thereof.

10. A method of providing a beam member flexible to a preselected curvilinear shape and adapted to be held in said preselected curvilinear shape, the beam member for use in a multi-component assembly wherein the beam member is attached to other components of the assembly, the method comprising the steps of:

(a) providing a flexible face having a longitudinal centerline and a plurality of apertures in said flexible face for use in attaching said beam member to the other components of the assembly;

(b) securing to and upstanding from said flexible face a plurality of flange members, said flange members are arranged side-to-side in at least one longitudinal row spaced from said longitudinal centerline of said flexible face;

(c) providing a terminal end section on each of said flanges extended parallel to said flexible face;

(d) forming and arranging so that each of said flanges is separated from an adjacent flange by a distance which increases from the attachment of the flange at said flexible face to said terminal end section whereby the beam member is laterally flexibly movable to conform to a preselected curvilinear shape; and (e) securing to said terminal end section of said flanges means to maintain the preselected curvilinear shape of the beam member.

11. A method as defined in claim 10, wherein said terminal end section of said flanges are turned outwardly away from said longitudinal centerline of said flexible face.

12. A method as defined in claim 10, wherein said flexible face includes a pair of opposing ends of said flexible face and further comprising the step of securing one each of a pair of end plates to a corresponding one of said ends of said flexible face.

13. A method as defined in claim 10, wherein said means for maintaining the preselected shape of the beam member comprises a flexible strap for each of said rows of flanges and positioned atop and adapted for connection to said terminal end sections.

14. A beam member as defined in claim 13, wherein said terminal end sections include a throughbore, said strap includes a plurality of slotted throughbores capable of being aligned with said throughbores of said terminal end sections and whereby said strap is releasably connected to said terminal end sections by a plurality of nut and bolt combinations inserted through said aligned throughbores.

15. A beam member as defined in claim 10, wherein said beam member includes two longitudinal rows of said flanges positioned on either side of and spaced from said longitudinal centerline of said flexible face.

16. A method as defined in claim 10, wherein said distance of separation between adjacent flanges extends substantially from the attachment of said flange members at said flexible face to said terminal end sections.

17. A method as defined in claim 10, wherein the longitudinal length of said flange members greatly exceeds the distance of separation between adjacent flange members.

18. A method as defined in claim 10, wherein said means for maintaining preselected shape further comprises:

(a) providing a flexible, originally planar strap with transverse dimension greatly exceeding the thickness of said flexible strap; and (b) said flexible strap flexes about any line in the original plane of said flexible strap and perpendicular to the longitudinal center line thereof.

* * * * *